United States Patent [19]

Hall

[11] Patent Number: 4,549,418

[45] Date of Patent: Oct. 29, 1985

[54] LOCK BOX AND METHOD OF MAKING SAME

[75] Inventor: Mitchell A. Hall, Ft. Thomas, Ky.

[73] Assignee: Monarch Tool & Manufacturing Co., Covington, Ky.

[21] Appl. No.: 475,141

[22] Filed: Mar. 14, 1983

[51] Int. Cl.[4] ..... E05B 65/46

[52] U.S. Cl. ..... 70/85; 70/417; 70/452

[58] Field of Search ..... 70/63, 85, 86, 417, 70/452; 194/1 R, 1 A, 1 B, 1 F; 232/15, 16, 1 R

[56] References Cited

U.S. PATENT DOCUMENTS

| | | | |
|---|---|---|---|
| 3,538,724 | 11/1970 | Davenbaugh | 70/86 |
| 3,738,134 | 6/1973 | Hall | 70/86 |
| 3,844,144 | 10/1974 | Schmitt | 70/86 |
| 4,133,419 | 1/1979 | Greenwald | 70/85 |
| 4,156,501 | 5/1979 | Greenwald | 232/15 |

*Primary Examiner*—Robert L. Wolfe

*Attorney, Agent, or Firm*—Kinney & Schenk

[57] ABSTRACT

A lock box and method of making same are provided wherein such lock box is mountable in an aperture of a cabinet wall and comprises; a coin receptacle dimensioned for passage through the aperture and having an open top and a front wall portion; a face member having a bore therethrough, a peripheral edge, and an inside surface; removable fasteners for fastening the receptacle to the face member by fastening the front wall portion thereto; at least one locking bolt carried by the face member and being movable to extended and retracted positions relative to a portion of the peripheral edge of the face member to engage a portion of the cabinet wall and fasten the lock box thereto upon extension of the bolt; a lock assembly carried by the face member and provided for operating the bolt with the lock assembly being accessible by a key through the bore; and the lock box includes dual purpose components for supporting the entire lock assembly inwardly of such inside surface and protecting same against removal thereof by thieves.

18 Claims, 11 Drawing Figures

21A
22A
30A
23A
20A
35A
26A
46A
25A
24A
31A
47
42A
31A
24A
81A
27A
10
91A
114A
100A
44A
95A
97A
105A
42A
80A
85A
87A
65A
75A
113A
44A
100A
93A
106A
42A
10
66
116
36
123
121
120
117
67X 71A
67A
35A
34A
41A
37A
47
41A 20A
45A
100A
44A
41A
56A
55A
44A
41A
45A
50A
35A
44A
45A
91A
91A
41A
100A
114A 110A
97A
96A
97A
75A
45A
114A
41A
100A
91A
91A
44A

LOCK BOX AND METHOD OF MAKING SAME

BACKGROUND OF THE INVENTION

1. Field of the Invention

This invention relates to lock box constructions and in particular to an improved lock box and method of making same.

2. Prior Art Statement

There are numerous product or service vending machines in use which are operated by coins, or the like, and in each such machine the coins are kept in a lock box, drawer, or compartment housed behind a cabinet wall of a vault of the machine. Authorized access to the lock box is provided through use of a key-actuated lock assembly comprising the lock box.

However, such a lock box and its lock assembly are the target of thieves and vandals and various structures and devices have been proposed heretofore for protecting same.

For example, it has been proposed to provide a lock assembly for a lock box wherein such lock assembly employs a hardened collar, or the like, which is resistant to filing chipping, or cutting action.

It has also been proposed in U.S. Pat. No. 4,122,695 to provide a hardened protective housing rotatably secured to the outer head portion of a lock assembly for a lock box to preclude access to and mistreatment of such outer head portion.

It has also been proposed in U.S. Pat. No. 3,738,134 to provide a face member comprising a lock box which is made of a metal which has been armored against cutting or drilling and which seeks to provide added security by recessing the forward portion of a lock assembly for such lock box within the face member while also providing hard metal inserts embedded in the face member so as to make it difficult to cut away such lock assembly utilizing a hole saw, or the like.

However, each of the previously proposed lock boxes, including those mentioned above, is basically deficient in that the lock assembly used therewith may, with minimum difficulty, be disabled by drilling through the key receiving portion thereof, picked with a lock picking tool, drilled out—as with a hole saw, or pried out.

SUMMARY OF THE INVENTION

This invention provides an improved lock box which overcomes the above-mentioned deficiencies.

In particular, the improved lock box of this invention is mountable in an aperture of a cabinet wall and comprises; a coin receptacle dimensioned for passage through the aperture and having an open top and a front wall portion; a face member having a bore therethrough, a peripheral edge, and an inside surface; removable fasteners for fastening the receptacle to the face member by fastening the front wall portion thereto; at least one locking bolt carried by the face member and being movable to extended and retracted positions relative to a portion of the peripheral edge of the face member to engage a portion of the cabinet wall and fasten the lock box thereto upon extension of the bolt; and a lock assembly carried by the face member and provided for operating the bolt with the lock assembly being accessible by a key through the bore.

In accordance with each embodiment of the improved lock box of this invention disclosed herein, dual purpose means is provided for supporting the entire lock assembly inwardly of the above-mentioned inside surface and protecting same against removal thereof by thieves.

Accordingly, it is an object of this invention to provide an improved lock box of the character mentioned.

Another object of this invention is to provide an improved method of making a lock box of the character mentioned.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DETAILED DESCRIPTION

Figures 1, 2, 3, 4, 5, 6:
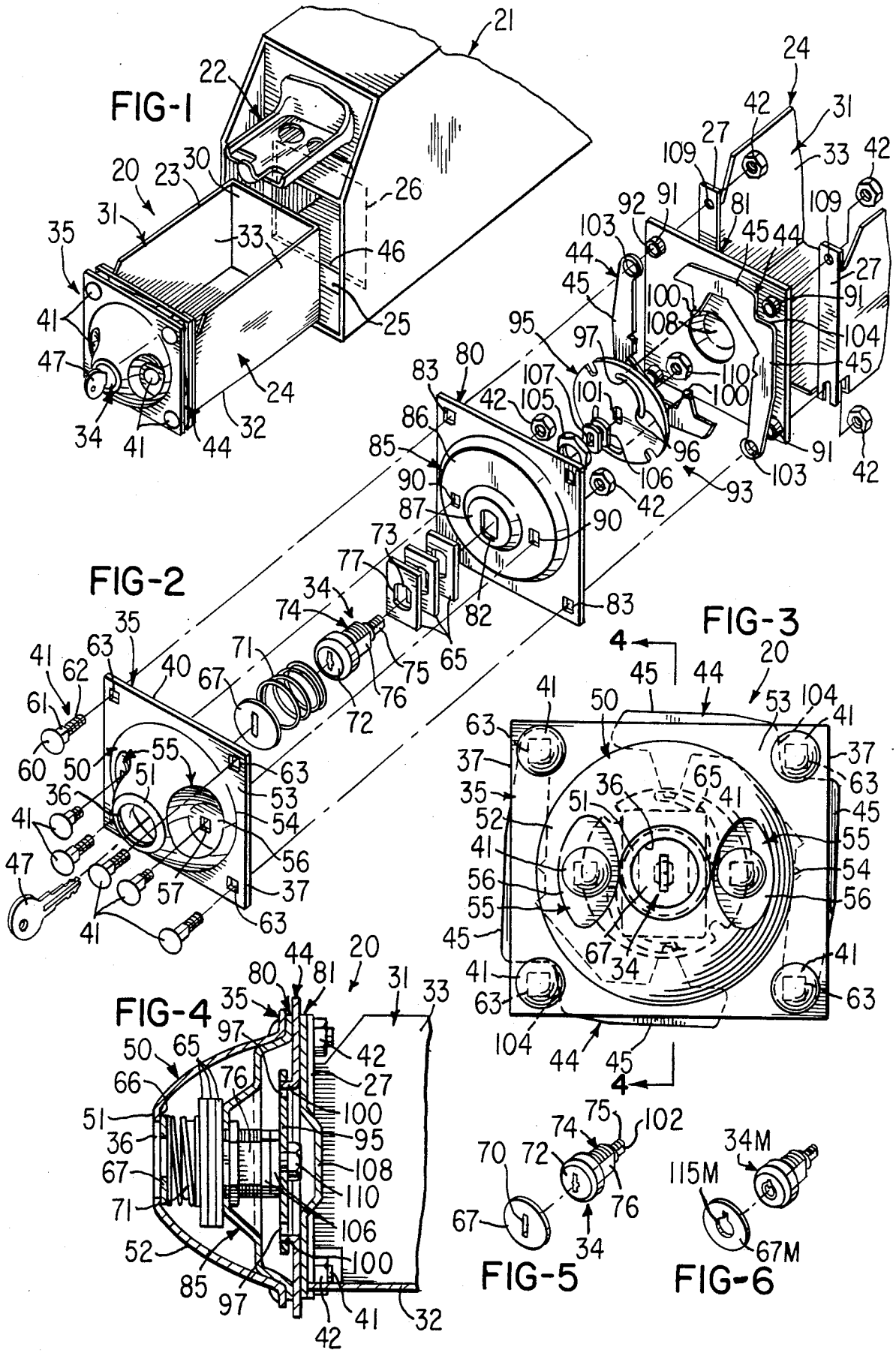
FIG. 1 is an isometric view with parts broken away showing one exemplary embodiment of the improved lock box of this invention which has a coin receptacle and showing the relationship of the lock box to a vending machine vault or casing and a cabinet wall of such vault, together with a coin slide which delivers coins to an open top of the coin receptacle.
FIG. 2 is an exploded isometric view, with a portion broken away, showing the components of the lock box of FIG. 1.
FIG. 3 is a front view of the lock box of FIG. 1 with movable locking bolts thereof shown in extended positions.
FIG. 4 is a cross-sectional view taken essentially on the line 4—4 of FIG. 3.
FIG. 5 is an isometric view of a lock assembly comprising the components of the lock box of FIG. 1 and a disc used in association therewith.
FIG. 6 is an isometric view similar to FIG. 5 and illustrating another exemplary embodiment of a lock assembly and associated disc.

Reference is now made to FIG. 1 of the drawings which illustrates one exemplary embodiment of the improved lock box of this invention which is designated generally by the reference numeral 20. The lock box 20 is particularly adapted to be used in a vault or casing, which is designated generally by the reference numeral 21, comprising a vending machine (not shown), or the like, which uses such vault or casing and wherein such vault carries a conventional coin slide 22. The coin slide 22 is particularly adapted to deliver coins to an open top 23 of a coin receptacle 24 comprising the lock box 20. The lock box 20 and vault 21 are particularly adapted to be used in association with service vending machines, such as, washers and dryers for clothing for example; or product vending machines, such as, food vending machines, for example, and the like.

The vault 21 has a plurality of walls including a cabinet wall 25 and an aperture 26 in such cabinet wall and the coin receptacle 24 of the lock box 20 is dimensioned for passage through the aperture 28 so that the lock box may be mounted and locked with the coin receptacle 24 extended through the aperture 26 and within the confines of the vault 21, and so that bolt means, to be subsequently described, comprising the lock box 20 may be extended to fasten, i.e., lock or bolt, the lock box to the cabinet wall as will be subsequently described.

As best seen in FIG. 2 of the drawings the coin receptacle 24 has front wall means 27, a rear wall 30 (FIG. 1), and enclosing wall means 31 disposed between the front wall means 27 and the rear wall 30 with an opening in such enclosing wall means 31 defining the open top 23 of the coin receptacle 24. The enclosing wall means 31 of the receptacle 24 of this example is defined by a flat bottom wall 32 and a pair of spaced apart parallel side walls each designated by the same reference numeral 33.

The lock box 20 is theft and/or vandal proof because the construction thereof makes it very difficult to forcibly remove or disable a lock assembly 34 comprising same. Thus, it is very difficult to forcibly enter the receptacle 24 and steal its contents.

The lock box 20 comprises a face member which is designated generally by the reference numeral 35 and has a bore 36 therethrough, a peripheral edge 37 which, in this example, is of rectangular outline, and an inside surface 40. The lock box 20 also comprises a plurality of removable fasteners comprising a plurality of carriage bolts 41 and associated nuts 42 for fastening the receptacle 24 to the face member 35 by fastening the front wall means 27 of such receptacle to such face member 24.

The lock box 20 further comprises bolt means, i.e., locking bolt means or locking bolts, consisting of a plurality of two L-shaped bolts each designated by the same reference numeral 44 which are carried by the face member 35, and such bolts 44 are movable to extended and retracted positions relative to the peripheral edge 37 of the face member 35 to engage a portion of the cabinet wall 25 and fasten the lock box 20 thereto upon extension of the bolt means or L-shaped bolts 44. In particular, upon extending the bolts 44 in a manner to be subsequently described, each of such L-shaped bolts has portions 45 which engage corresponding portions on the inside surface 46 of the cabinet wall 25 to thereby fasten the lock box 20 to such cabinet wall.

As previously mentioned the lock box 20 has a lock assembly 34 (FIGS. 2 and 4), and the lock assembly 34 is provided for operating the bolt means or bolts 44. As best seen in FIG. 2, the lock assembly 34 may be opened using an associated key 47 therefor which is extended through the bore 36.

The lock box 20 has dual-purpose means, provided in accordance with the teachings of this invention and in a manner to be described in detail subsequently, for supporting the entire lock assembly 34 inwardly of the inside surface 40 of the face member 35 and protecting such lock assembly 34 against removal thereof and/or damage thereto by thieves, vandals, or the like, so as to disable same.

Referring now to FIGS. 2 and 4 of the drawings it is seen that the face member 35 has a roughly cup-shaped central portion which is designated generally by the reference numeral 50 and such cup-shaped portion is defined by an outer circular wall 51 which is an annular wall and is adjoined by a substantially frustoconical wall 52. The entire face member 35 is also made of a hard metal which preferably has a hard surface finish, such as a nickel finish, or the like. Thus, the construction and configuration of the face member 25 and the hard metal with its hard surface finish used in its construction make cutting, sawing, drilling, filing, prying, striking, or other disabling damage to such face member 35 very difficult. In addition, any attempt to cut through the cup-shaped portion 50 with a hole saw, or the like, requires cutting through a substantial thickness of metallic material due to the frustoconical configuration thereof.

The face member 35 of this example is preferably a single-piece structure and has a substantially planar peripheral part 53 which adjoins the large diameter end 54 of the frustoconical wall 52. In addition, the member 35 has at least one recess; and, in this example a plurality of two recesses which are designated by the same reference numeral 55 are provided in the frustoconical wall 52. Each recess 55 has a flat bottom wall 56 (FIG. 2) provided with a square opening 57 therein for a purpose to be subsequently described.

As previously mentioned, the lock box 20 has a dual-purpose means for supporting the entire lock assembly 34 inwardly of the inside surface 40 of the face member 35. The dual-purpose means in this example comprises a plurality of carriage bolts, four of which define outer removable fasteners 41 which were used for fastening the receptacle 24 to the face member 35. The four outer fasteners will be referred to interchangeably as fasteners 41 or carriage bolts 41; and, it will be appreciated that the carriage bolts utilize threaded nuts 42 in association therewith. The plurality of carriage bolts mentioned above also include two carriage bolts, each also designated by the reference numeral 41, which extend through associated holes 57 in associated bottom walls 56 of their recesses 55. As is typical of a carriage bolt, each carriage bolt 41 has a rounded metal head referred to in the art as a snap head 60, a square metal neck portion or neck 61 which adjoins the snap head 60, and a threaded portion 62 adjoining the square neck 61.

The carriage bolts 41 which are associated with recesses 55 have the square necks 61 thereof dimensioned to fit snugly within their associated square holes 57. Likewise, the remaining carriage bolts 41 which are associated with the planar peripheral part 53 have square necks 61 extending through associated square holes 63 in a snug-fitting manner. The square necks 61 engage surfaces defining holes 57 and 63 to prevent rotation of such carriage bolts with respect to the face member 35. Thus, in the manner of carriage bolts, it is a simple manner to assemble the remaining components of the lock box 20 to the face plate 35 and fasten all such components to the inside surface of the face plate by threading nuts 42 on threaded portions 62 of the carriage bolts.

As seen in the drawings, the construction and arrangement of the lock box is such that the carriage bolts have their rounded or snap heads disposed in a flush manner against the outside surface of the face member 35 making it practically impossible to insert a tool beneath the heads thereof. Further, the smooth rounded configuration of the snap heads 60 make it impossible to engage a tool, such as, a screw driver or the like, thereagainst for turning purposes.

The carriage bolts 41, and particularly the heads 60 thereof, are preferably made of hardened metal. The hardened metal and the arrangement of metal heads 60 make cutting through the face member with a hole saw, or the like, immediately around the lock assembly 34 practically impossible except for a selected annular area within the confines of the two inner carriage bolts 41 which are disposed within the recesses 55. However, at this annular area it is impossible to cut therethrough with a hole saw because of a plurality of hardened metal discs 65 which are supported in a nonrotatable manner by the lock assembly 34, as will be subsequently described.

As best seen in FIGS. 2 and 4 of the drawings, the bore 36 in the face member 35 extends through the circular wall 51 thereof and defines an annular inside supporting surface 66. The previously described dual-purpose means for supporting the entire lock assembly 34 and protecting same against removal by thieves further comprises a circular movable disc 67 supported against the annular surface 66 while being movable relative thereto. As seen in FIG. 5 the movable disc has a slot 70 therein which is adapted to receive a key 47 for the lock assembly 34 therethrough. The movable disc 67 is movable both in a rotating and a floating manner relative to a central longitudinal axis of the lock assembly 34 and such movability makes drilling through the lock assembly 34 or the stabilizing of a lock picking tool for picking the lock assembly 34 very difficult.

The lock box 20 also comprises spring means shown in this example as a compression spring 71 which is compressed between the inside surface of the disc 67 and the forward surface 72 of the lock assembly 34. The spring means or spring 71 enables movement of the disc 67 in a rotating and floating manner as previously mentioned.

As mentioned earlier, the lock box 20 utilizes hardened spacer means or hardened spacers 65 which are supported in a non-rotating manner around the lock assembly 34. Each hardened spacer 65 has a roughly rectangular peripheral outline and has an opening 73 therethrough which is provided with opposed parallel flat sides 77. The opening 73 enables the hardened spacers 65 to be disposed concentrically around the stationary outer central part 74 of the lock assembly 34. The outer central part 74 of the lock assembly 34 has two flat sides 76 which correspond to the flat sides 77 of the openings 73 in the spacers 65 whereby once the lock box 20 is in assembled relation the outer central part 74 of the lock assembly 34 is held in an axially confined manner and against rotation and the spacers 65 are prevented from rotating by surfaces 77 thereof engaging flat sides 76 of part 74.

If desired, the spacers 65 may have their dimension which is shown as a vertical dimension in FIGS. 2 and 3 of the drawings increased, as desired. In this manner it would be practically impossible to drill out the lock assembly 34 without striking the hardened spacers 65 or the heads 60 of the two inner carriage bolts 41. It should also be appreciated that the vertical dimension of each rectangular spacer 65 may be increased, if desired, such that it is substantially equal to the inside diameter of the frustoconical wall 52 at the corresponding position of such spacer along the central axis of wall 52.

In this example of the invention a plurality of three hardened spacer means or spacers 65 of equal thickness are illustrated as comprising the lock box 20; however, it will be appreciated that any desired number may be utilized for this purpose. Further, the thickness of each spacer 65 may be any desired thickness; and, the configuration of each may be varied, as desired, provided that such spacers are disposed in a non-rotating manner around the outer central part 74 of the lock assembly 34 and correlated with the axial dimension of part 74.

The lock box 20 also includes a first plate 80 and a second plate 81 which are of rectangular outline and fastened to the rectangular face member by the fastening means or carriage bolts 41. Thus, the lock box 20 is, in essence, a three plate construction inasmuch as the face member 35 is also a plate.

The plate 80 adjoins the face plate 35 and has a central opening 82 therein which corresponds in configuration to the outline of the outer central part 74 of the lock assembly 34. Accordingly, opening 82 has a pair of straight sides which are adapted to receive the corresponding flats 76 of the outer central part 74 of the lock assembly 34 to prevent relative rotation therebetween. The plate 80 also has square corner holes 83 which are adapted to be aligned with the square holes 63 of the face member 35 and adapted to receive the square necks 61 of the corner carriage bolts 41 therewithin in a snug-fitting manner and the surfaces defining holes 63 and 83 prevent rotation of such carriage bolts 41 once the bolts 41 are installed in position.

The plate 80 also has a substantially cylindrical cup-shaped central portion 85 which is concave or opens toward the receptacle 24 and for a purpose to be subsequently described. The cup-shaped portion 85 has a main flat bottom 86 which in turn has a second cup-shaped portion 87 which is concave in the same direction as the cup-shaped portion 85. The opening 82 is provided in the second cup-shaped portion 87. The plate 80 also has a pair of square holes 90 which are adapted to be aligned with associated square holes 57 in the bottom walls 56 of recesses 55 in the face member 35. The aligned square holes 57 and 90 receive the square necks 61 of the central carriage bolts 41 therewithin and the surfaces defining such square holes prevent relative rotation between the central bolts 41 and their plates 35 and 80.

The plate 81 also has cylindrical tubular spacers 91 fixed to its corners in aligned relation with circular corner holes 92 therein. The holes 92 are in aligned relation with the square corner holes 83 and 63 and the openings in the tubular spacers 91. A pair of diagonally disposed spacers 91 have outside surfaces which serve as pivots for the bolts 44.

As seen in FIG. 2, the bolts 44 are disposed in sandwiched relation between the plates 80 and 81 and are adapted to be actuated or moved to extended and retracted positions relative to the peripheral edge 37 of the face member 35 by cam means designated generally by the reference numeral 93. The action of cam means 93 will be described in detail subsequently.

The lock assembly 34 has a rotatable central portion 75 which extends from its inner end and is adapted to be rotated by the key 47. It will be appreciated that the entire lock assembly 34, once installed in position in the lock box 20, is confined axially. In addition, the face member 35, plate 80, and plate 81 prevent rotation of outer central part 74 of the lock assembly 34 relative to plates 35, 80, and 81 due to the flat surfaces 76 thereof engaging corresponding flat surfaces in the plate 80 defining opening 82. However, the central inner end portion 75 of lock assembly 34 is adapted to engage a part of the cam means 93 and provides direct movement thereof and in turn movement of the bolts 44 to their extended and retracted positions relative to the peripheral edge 37 of face member or plate 35 upon rotation of the central portion 75 of the lock assembly 34 in the usual manner using key 47.

The cam means 93 of this example of the invention comprises a cam disc 95 which is keyed to the central inner end portion 75 of the lock assembly 34 and cam surface means on the cam disc 95. The cam surface means on the disc 95 comprise cooperating pairs of cam surfaces 96 each defined by an associated slot 97 in the disc. In this example, a pair of slots 97 an a pair of cam surfaces 96 associated with each slot are defined in the cam plate 95.

The cam means 93 also comprises driven projection means shown as a pair of integral projections or tongues 100 each extending from an associated bolt 44. Each projection or tongue 100 is received in an associated cam slot 97 for engagement by associated cam surface means or cam surfaces 96.

With the lock box 20 in assembled relation the operation of the cam means 93 will be readily understood. In particular, upon rotating the central inner portion 75 of the lock assembly 34 by direct action of the key 47, the cam disc 95 is rotated in a corresponding direct manner thereby moving the cam surfaces 96. The cam surfaces 96, in turn, move the driven projection means or projections 100 engaged thereby to thereby move the bolt means or bolts 44. In this manner, after insertion of the key 47 in the lock assembly 34, rotation of such key in one direction, preferably clockwise in this example, extends the bolts 34 to their extended or locked positions and rotation of such key in a counterclockwise direction moves the bolts 44 to their retracted or unlocked positions.

As seen in FIG. 2, the cam disc 95 of this example is a substantially flat circular disc and has a central opening or hole 101 therein which is provided with at least one flat surface. The central hole 101 is dimensioned such that the key-rotatable inner end portion 75 of the lock assembly 34 is adapted to be received through such hole 101 so that a flat surface 102 of portion 75 (see FIG. 5) is adapted to engage a corresponding flat surface on the cam disc 95 which defines a side of the hole 101. Actually the hole 101 has a pair of diametrically disposed parallel flat sides and the inner end 75 has a corresponding pair of diametrically disposed flat surfaces 102 which are adapted to engage the portions of the disc defining the flat sides of the hole 101. In this manner, the cam disc 95 is keyed in a direct manner to the inner end portion 75 of the lock assembly 34 and is operable by the direct action thereof.

As previously mentioned, the lock box 20 has a pair of bolts 44 and the bolts of this example are L-shaped bolts which have integral bolting projections 45 extending therefrom. Each L-shaped bolt is supported for movement in a pivoting manner; and, each bolt has a cylindrical opening 103 in an end portion of one of its arms. Each opening 103 is adapted to be disposed around an associated cylindrical tubular pivot 91 for movement in a pivoting manner thereabout.

The manner in which the components of the lock box 20 are disposed in assembled relation will be readily apparent from FIG. 2. Once the lock box 20 is assembled, the tongues or projections 100 are disposed within their associated slots 97 in the cam plate 95. Further, with the provision of two L-shaped bolts 94 only two of the tubular spacers 91 are utilized as pivots. Also, inasmuch as the lock box 20 of this example utilizes a rectangular face member 35 and corresponding rectangular plates 80 and 81 the other two tubular spacers 91 which are provided in diametrically opposed corners of plate 81, and which are not used as pivots for the bolts 44, serve as stops for bolts 44.

In particular, it will be seen that each L-shaped bolt 44 has a notch or cutout 104 (FIG. 2) in the bight which is defined by the intersection of the legs defining its L-shaped configuration. The cutout 104 defines an L-shaped outside surface in the corner of its bolt which is adapted to engage the outside surface of an associated member 91 whereby such member serves as a stop which determines the fully extended or locked position of its associated bolt 44.

The lock box 20 utilizes a threaded nut 105 which is threaded over male threads of portion 74 of the lock assembly 34 and nut 105 holds such lock assembly firmly in position against the central plate 80. In addition, cam spacing means shown as a pair of cam spacers 106, in this example, are provided for spacing the cam plate 95 of the cam means 93 in the desired position in the lock box 20.

The spacers 106 have central openings 107 therein which correspond to the outer configuration of the central inner end portion 75 of the lock assembly 34 with its flats 102 whereby such spacers 106 are installed in position for rotary movements with such central inner end portion 75 and cam plate 95 upon rotating portion 75. In this example, with two spacers 106 being provided, the spacer 106 closest to assembly 34 engages a shoulder provided at the inner end of the portion 74 to thereby assure that the central portion 75 may be rotated by key 47 with minimum resistance.

As previously described, the central plate 80 has a pair of cup-shaped recesses 85 and 87 defined therein. The recess 85 is particularly adapted to receive therewithin the cam plate 95 together with the projections 100 extending from the bolts 44. Likewise, the smaller cup-shaped recess 87 extending from the bottom wall of the recess 85 is particularly adapted to receive the nut 105 and spacers 106. The cup-shaped recess 85 also receives the nuts 42 associated with the central carriage bolts 41 which extend through recesses 55 in the face member 35.

The plate 81 also has a cup-shaped recess 108 defined therein, as seen in FIG. 4. The recess 108 is particularly adapted to receive any extension of the central portion 75 of the lock assembly 34 as well as a nut 110 which is utilized to fasten the cam plate 95 and spacers 106 to the central inner end portion 75 of the lock assembly 34. Nevertheless, the plate 81 is basically a solid plate which is free of openings therein, except for corner openings or holes 92.

Thus, it is seen that the rear surface of the plate 81 cooperates with the front wall means 27 of the receptacle 24 to define an opening-free front wall for such receptacle 24. The front wall means 27 previously described, in essence, consists of a pair of flanges which are fixed against the inside surface of the plate 81 and such flanges are fixed in position against plate 81 by threading nuts 42 of the corner carriage bolts 41 in position, after extending the threaded portions of such bolts 41 through holes 92 in plate 81 and opening means 109 in the front wall means or flanges 27.

Once the lock box 20 with all components thereof are in assembled relation a plurality of three plate-like members or plates consisting of face member or plate 35 and plates 80 and 81 are provided. Any tendency to pry against the heads of the corner carriage bolts 41 merely serves to hold the plates 35 and 80–81 together in a tighter manner while holding the bolts 45 in their locked positions. This action further assures that the face member 35 and lock box 20 cannot be pried away from its associated cabinet wall 25. The locking bolts 44 disclosed herein are of optimum simplicity; however, it will also be appreciated that such bolts 44 may be modified in the manner disclosed in the above-mentioned U.S. Pat. No. 3,738,134 to avoid rattling or looseness once the lock box is installed in its associated cabinet wall. The teachings of the above-mentioned features, which are usable for bolts 44, as well as any other desired features of this patent are incorporated herein by reference thereto.

The receptacle 24 of lock box 20 may be made of any suitable material known in the art. For example, metallic materials which have been protected against corrosion may be used as well as high-strength non-metallic materials, or the like.

Another exemplary embodiment of the lock box of this invention is illustrated in FIGS. 7 through 10 of the drawings. The lock box illustrated in FIGS. 7 through 10 is similar to the lock box 20; therefore, such lock box will be designated generally by the reference numeral 20A and representative parts of such lock box 20A together with their associated structure which are similar to corresponding parts of the lock box 20 will be designated in the drawings by the same reference numerals as in the lock box 20 (whether or not such representative parts are mentioned in the specification) followed by the letter designation "A" and not described again in detail. Only those component parts of the lock box 20A which are substantially different from corresponding parts of the lock box 20 will be designated by new reference numerals also followed by the letter designation "A" and described in more detail.

Figures 7, 8, 9, 10, 11:
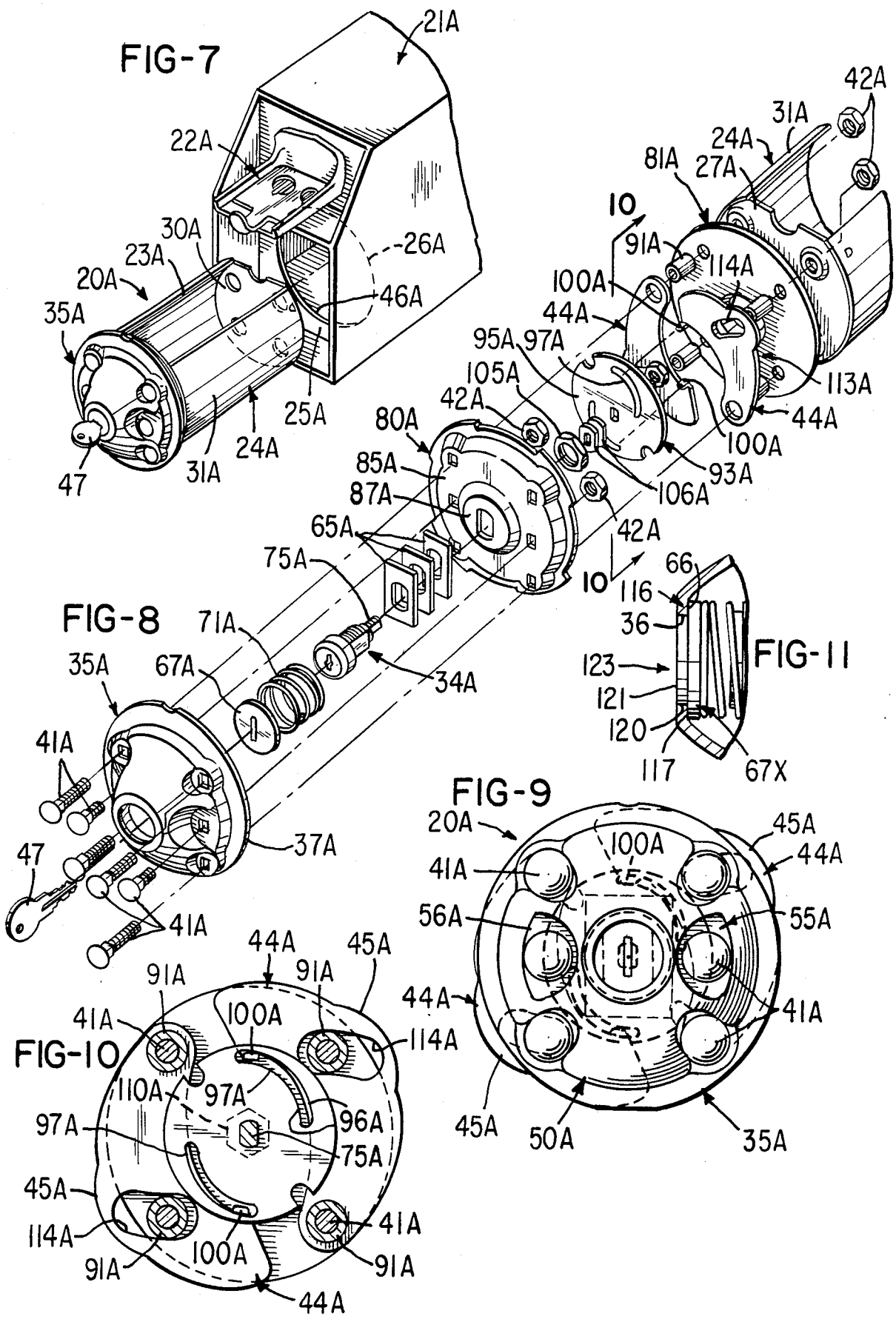
FIG. 7 is a view similar to FIG. 1 illustrating another exemplary embodiment of a lock box of this invention together with an associated vending machine vault, cabinet wall to such vault, and coin slide.
FIG. 8 is a view similar to FIG. 2 of the lock box of FIG. 7.
FIG. 9 is a front view similar to FIG. 3 of the lock box of FIG. 7.
FIG. 10 is a view taken essentially on the line 10—10 of FIG. 8 with the lock box assembled.
FIG. 11 is a fragmentary view similar to the forward portion of FIG. 4 and particularly illustrating a typical modified disc used in association with a typical lock assembly.

As seen in FIG. 7, the lock box 20A is particularly adapted to be used in a vault 21A having a cabinet wall 25A provided with an aperture 26A which is of circular outline so that with the coin receptacle 24A within the confines of the vault 21A the lock box may be bolted or locked in position to securely fasten the lock box 20A in a similar manner as previously described for the lock box 20.

As mentioned above, the lock box 20A is used in association with circular aperture 26A whereby the face member 35A, plates 80A–81A and the end view of the coin receptacle 24A have basically circular outlines which correspond to the aperture 26A. In this manner the receptacle 24A and plates 80A–81A may be received within such aperture 26A with the rear surface of the face member 35A flush against the front surface of the cabinet wall 25A and the lock box 20A locked in position.

In this example, the receptacle 24A has front wall means in the form of a basically complete or continuous front wall 27A. Further, such receptacle 24A has a rear wall 30A which corresponds in configuration to its front wall 27A and enclosing wall means 31A disposed between the walls 27A and 30A. The enclosing wall means 31A of this example is defined by a substantially tubular cylindrical wall with an opening or cut away portion at the top thereof which defines an opening or open top 23A in the receptacle 24A.

The construction and operation of the lock box 20A is substantially identical to the construction and operation of the lock box 20 whereby the lock box 20A is also theft and/or vandal proof. Accordingly, and as seen in FIG. 8, the lock box 20A also utilizes a movable disc 67A, compression spring 71A, hardened spacers 65A and plates 80A and 81A.

In a similar manner as described before for lock box 20, the plate 80A has cup-shaped portions 85A and 87A and also utilizes cam disc 95A. The lock box 20A also utilizes carriage bolts 41A and associated nuts 42A and basically all of the features of construction previously described for lock box 20 are applicable, except where modification is required to take into account the circular configuration of the face plate 35A, the plates 80A and 81A, and other components to enable use of the lock box 20A in circular aperture 26A in wall 25A as mentioned earlier.

The bolts 44A of the lock box 20A are operated in a direct-acting manner by key 47 operating in the lock assembly 34A. As in the case of lock box 20, this reference to direct action means that key 47 acts directly upon manual rotation thereof; to rotate the central inner portion 75A of the lock assembly 34A thereby actuating the cam plate 95A and in turn bolts 44A in a direct manner. This direct actuation of the bolts 44A causes movement of portions 45A thereof so that such portions 45A engage the inside surface 46A of the cabinet wall 25A to thereby fasten the lock box 20A to such cabinet wall.

The portions 45A of this example are moved in a direct manner by rotation of the key 47 clockwise to thereby rotate the central inner end portion 75A of the lock assembly 34A and through the action of cam means 93A portions 45A are extended beyond the peripheral edge 37A of the face plate 35A. The portions 45A are moved to their retracted positions by rotation of the key 47 counterclockwise and again employing the cam means 93A.

Because of the circular configuration of the face plate 35A, it will be appreciated that the bolts 44A instead of being substantially L-shaped, as in the case of bolts 44, such bolts 44A are what might be considered crescent shaped and as will be readily apparent at 113A in FIG. 8. It will also be seen that due to the crescent shaped configuration shown at 113A, the bolts 44A have alongate slots 114A therein which allow extending and retracting movements thereof with the bolts 44A installed in position. Each slot 114A is adapted to receive an unused pivot 91A therethrough in a non-obstructing manner. The surfaces defining slots 114A of the crescent-shaped bolts 44A serve the same purpose as the cutouts 104 provided in the L-shaped bolts 44 of the lock box 20.

The bolts 44A also have projections 100A which extend through associated slots 97A and engage cam surfaces defining such slots. Accordingly, the cam plate 95A upon rotation thereof operates the bolts 44A in a similar manner as previously described for the corresponding components of the lock box 20.

Identification and further description could be provided for all the other components of the lock box 20A illustrated in FIGS. 7 through 10; however, such identification and further description is not considered necessary because of the similarity of the components to the corresponding components of the lock box 20.

The disc 67A used in the lock box 20A is substantially identical to disc 67 of the lock box 20; and, likewise the lock assembly 34A is substantially identical to the lock assembly 34. However, it is to be understood that the disc may be modified so that it cooperates with an associated lock assembly and a modified disc 67M and modified lock assembly 34M are illustrated in FIG. 6 of the drawings. The disc 67M and lock assembly 34M may be used interchangeably with the corresponding disc and lock assembly of either the lock box 20 or the lock box 20A.

It will also be appreciated that there are numerous lock assemblies available in the art; however, for simplicity only one different lock assembly 34M is illustrated in FIG. 6 and the assembly of FIG. 6 and its disc 67M is described as being interchangeable with the lock assemblies of lock box 20 and 20A. Nevertheless, it is to be understood that there may be at least seven to a dozen lock assemblies or more, which may be used interchangeably with the lock assemblies 34 and 34A and each interchangeable lock assembly may be provided with its special movable disc in association therewith which is modified so as to receive a cooperating special key. Thus, the lock assembly 34M is adapted to receive a keyhole-shaped key (not shown) of known construction which is adapted to be received in a corresponding keyhole-shaped slot 115M in the disc 67M, and a similar cooperating access opening in the assembly 34M.

In some applications of this invention, the disc used in association with its lock box may be modified by providing an annular peripheral recess 116 in the outer portion thereof as shown in FIG. 11, and such disc is designated by the reference numeral 67X. The recess 116 is such that it defines an annular planar surface 117 which engages the annular inside surface 66 of lock box 20, for example, and recess 116 also defines a cylindrical surface 120 which is free to rotate smoothly and in a non-interfering manner in the bore 36. The disc 67X also has an outside surface 121 which is substantially coplanar with the outside surface of the bottom wall of the cup-shaped portion of its associated face member as shown at 123. The construction of disc 67X makes it is even more difficult to stabilize a lock picking tool against a stationary part of the lock box 20 for lock-picking purposes. It will also be appreciated that the configuration of the disc 67X shown in FIG. 11 is fully applicable to disc 67, 67A, 67M or any modified version of a disc utilized with a lock box similar to the lock box 20 or 20A.

In this disclosure of the invention use has been made of terms such as bottom, top, inwardly, outwardly, front, rear, inside, and the like. However, it is to be understood that these terms are used to describe each lock box and various components thereof as illustrated in the drawings and such terms are not to be considered limiting in any way.

While present exemplary embodiments of this invention, and methods of practicing the same, have been illustrated and described, it will be recognized that this invention may be otherwise variously embodied and practiced within the scope of the following claims.

What is claimed is:

1. In a lock box mountable in an aperture of a cabinet wall and comprising; a coin receptacle dimensioned for passage through said aperture and having an open top and front wall means; a face member having a bore therethrough, a peripheral edge, an outside surface, and an inside surface; removable fasteners for fastening said receptacle to said face member by fastening said front wall means thereto; bolt means carried by said face member including at least one bolt movable to extended and retracted positions relative to a portion of said peripheral edge of said face member to engage a portion of said cabinet wall and fasten said lock box thereto upon extension of said bolt means; and a lock assembly carried by said face member and provided for operating said bolt means; said lock assembly being accessible by a key through said bore; the improvement comprising dual-purpose means for supporting said lock assembly inwardly of said inside surface and protecting same against removal thereof by thieves, said face member having a roughly cup-shaped central portion defined by an outer circular wall adjoined by a substantially frustoconical wall, said face member being made of a hard metal and having a hardened surface finish which makes cutting thereof very difficult, and said dual-purpose means comprising at least one headed bolt having a metal head disposed flush against said outside surface of said face member and within the confines of said frustoconical wall, said headed bolt serving to limit the locations where cutting through said face member might be attempted.

2. A lock box as set forth in claim 1 in which said face member has a substantially planar peripheral part adjoining the large diameter end of said frustoconical wall and a pair of recesses in said frustoconical wall, each of said recesses having a flat bottom wall with an opening therein, said one headed bolt being a carriage bolt having a rounded metal head, and said dual-purpose means comprising at least another carriage bolt also having a rounded metal head disposed flush against the outside surface of said face member, each of said carriage bolts extending through an associated opening in an associated flat bottom wall with its metal head flush against a flat portion of said outside surface of said face member which defines said flat bottom wall, and said carriage bolts are disposed on said face member and cooperate so as to limit said locations where cutting through said face member might be attempted.

3. A lock box as set forth in claim 2 in which said bore in said face member extends through said circular wall thereof and defines an annular inside supporting surface, and said dual-purpose means further comprises a circular disc supported against said annular inside supporting surface while being movable relative thereto, said movable disc having a slot therein which is adapted to receive a key for said lock assembly therethrough, said movable disc being movable both in a rotating and a floating manner relative to a longitudinal axis of said lock assembly making drilling through said lock assembly or stabilizing of a lock-picking tool for picking said lock assembly practically impossible.

4. A lock box as set forth in claim 3 and further comprising spring means compressed between the inside surface of said disc and a forward surface of said lock assembly, said spring means enabling movement of said disc in said rotating and floating manner.

5. A lock box as set forth in claim 4 in which said spring means is a compression spring.

6. A lock box as set forth in claim 4 and further comprising hardened spacer means supported in a non-rotating manner around said lock assembly rearwardly of said forward surface thereof, said hardened spacer means preventing cutting out of said lock assembly in a coring manner with a hole saw.

7. A lock box as set forth in claim 3 in which said dual-purpose means further comprises a first and a second plate fastened by said carriage bolts to said face member inwardly of said inside surface and wherein said carriage bolts also define said removable fasteners.

8. A lock box as set forth in claim 7 in which said bolt means is disposed in sandwiched relation between said first and second plate and further comprising cam means also disposed between said first and second plate for actuating said bolt means.

9. A lock box as set forth in claim 8 in which said lock assembly has a central portion provided with an inner end portion which engages a part of said cam means, said inner end portion serving to provide direct movement of said cam means and in turn movement of said bolt means to said extended and retracted positions relative to said peripheral edge of said face member upon rotation of said central portion with said key.

10. A lock box as set forth in claim 9 in which said cam means comprises, a cam disc keyed to said inner end portion, cam surface means on said cam disc defined by cam slot means, and driven projection means extending from said bolt means and being received in said cam slot means for engagement by said cam surface means, whereby upon rotation of said central portion with said key said cam disc is rotated in a direct manner moving said cam surface means and in turn said driven projection means engaged thereby to thereby move said bolt means.

11. A lock box as set forth in claim 10 in which said cam disc comprises a substantially circular disc and has a hole therein provided with at least one flat surface, said bolt means comprises a pair of bolts, said inner end portion is adapted to be received through said hole and has a flat surface which is adapted to engage said flat surface of said cam disc, said cam surface means comprises a plurality of cam surfaces defined by said cam slot means in the form of a pair of cam slots, and said driven projection means comprises a pair of driven projections each extending from an associated bolt with each projection being received in an associated cam slot for engagement by associated cam surface means, whereby upon rotating said central portion with said key said cam disc is rotated moving said cam surfaces thereof and in turn said driven projections engaged thereby to move said pair of bolts.

12. A lock box as set forth in claim 11 and further comprising a plurality of four tubular spacer members each fixed to said second plate and extending toward said first plate and in which said pair of bolts comprises a pair of L-shaped bolts each having bolting projections extending therefrom, each of said bolts being movable to said extended and retracted positions by moving each L-shaped bolt in a pivoted manner about an associated tubular spacer member which serves as a pivot therefor.

13. A lock box as set forth in claim 12 in which each tubular spacer member has an associated carriage bolt extending therethrough and two tubular spacer members which do not operate as pivots serve as stops for said L-shaped bolts.

14. In a lock box mountable in an aperture of a cabinet wall and comprising; a coin receptacle dimensioned for passage through said aperture and having an open top and front wall means; a face member having a bore therethrough, a peripheral edge, and outside surface, and an inside surface; removable fasteners for fastening said receptacle to said face member by fastening said front wall means thereto; bolt means carried by said face member including at least one bolt movable to extended and retracted positions relative to a portion of said peripheral edge of said face member to engage a portion of said cabinet wall and fasten said lock box thereto upon extension of said bolt means; and a lock assembly carried by said face member and provided for operating said bolt means; said lock assembly being accessible through said bore; the improvement comprising dual-purpose means for supporting said lock assembly inwardly of said inside surface and protecting same against removal thereof by thieves, said face member having a roughly cup-shaped central portion defined by an outer circular wall adjoined by a substantially frustoconical wall, said face member being made of a hard metal and having a hardened surface finish which makes cutting thereof very difficult, said bore in said face member extending through said circular wall thereof and defining an annular inside supporting surface, said dual-purpose means comprising a circular disc supported against said annular inside supporting surface while being movable relative thereto, said movable disc having a slot therein which is adapted to receive a key for said lock assembly therethrough, said movable disc being movable both in a rotating and a floating manner relative to a longitudinal axis of said lock assembly making drilling through said lock assembly or stabilizing of a lock-picking tool for picking said lock assembly practically impossible, and said dual-purpose means further comprising at least one headed bolt having a metal head disposed flush against said outside surface of said face member and within the confines of said frustoconical wall, said headed bolt serving to limit the locations where cutting through said face member might be attempted.

15. A lock box as set forth in claim 14 in which said peripheral edge is an edge of substantially rectangular outline.

16. A lock box as set forth in claim 14 in which said peripheral edge is an edge of substantially circular outline.

17. In a method of making a lock box which is mountable in an aperture of a cabinet wall and wherein said method comprises the steps of; providing a coin receptacle dimensioned for passage through said aperture and having an open top and front wall means; providing a face member having a bore therethrough, a peripheral edge, an outside surface, and an inside surface; fastening said receptacle to said face member by fastening said front wall means thereto with removable fasteners; providing bolt means carried by said face member and including at least one bolt movable to extended and retracted positions relative to a portion of said peripheral edge of said face member to engage a portion of said cabinet wall and fasten said lock box thereto upon extension of said bolt means; and providing a lock assembly which is carried by said face member and provided for operating said bolt means; said lock assembly being accessible by a key through said bore, the improvement in said method comprising the step of providing dual-purpose means for supporting said lock assembly inwardly of said inside surface and protecting same against removal thereof by thieves, said step of providing said face member comprises providing said face member having a roughly cup-shaped central portion defined by an outer circular wall adjoined by a substantially frustoconical wall with said face member being made of a hard metal and having a hardened surface finish making cutting thereof very difficult, and said step of providing dual-purpose means comprising the steps of providing at least one headed bolt having a metal head and attaching said headed bolt against said face member with its metal head flush against said outside surface of said face member and within the confines of said frustoconical wall, said headed bolt serving to limit the locations where cutting through said face member might be attempted.

18. A method as set forth in claim 17 in which said bore in said face member extends through said circular wall thereof and defines an annular inside supporting surface and said step of providing dual-purpose means comprises providing a circular disc and supporting said disc against said annular inside supporting surface so that said disc is movable relative thereto, said movable disc having a slot therein which is adapted to receive a key for said lock assembly therethrough, said movable disc being movable both in a rotating and a floating manner relative to a longitudinal axis of said lock assembly making drilling through said lock assembly or stabilizing of a lock picking tool for picking said lock assembly practically impossible.

* * * * *